US005794374A

United States Patent [19]

Crandall

[11] Patent Number: 5,794,374

[45] Date of Patent: Aug. 18, 1998

[54] GUN BARREL STABILIZER

[76] Inventor: David L. Crandall, 11040 N. River Rd., Idaho Falls, Id. 83402

[21] Appl. No.: 781,341

[22] Filed: Jan. 21, 1997

[51] Int. Cl.[6] ..... F41C 27/00

[52] U.S. Cl. ..... 42/97; 42/76.01; 89/14.2; 89/14.3

[58] Field of Search ..... 42/97, 76.01, 76.02, 42/1.06; 89/14.05, 14.1, 14.2, 14.3, 14.4

[56] References Cited

U.S. PATENT DOCUMENTS

| | | | |
|---|---|---|---|
| Re. 35,381 | 11/1996 | Rose | 89/14.3 |
| 2,466,400 | 4/1949 | Ennis | 42/79 |
| 3,732,778 | 5/1973 | Bettermann et al. | 89/14 R |
| 3,812,610 | 5/1974 | Kranz | 42/79 |
| 4,635,528 | 1/1987 | McQueen | 89/14.3 |
| 4,643,073 | 2/1987 | Johnson | 89/14.3 |
| 4,726,280 | 2/1988 | Frye | 89/16 |
| 4,852,460 | 8/1989 | Davidson | 89/14.05 |
| 4,913,031 | 4/1990 | Bossard et al. | 89/14.3 |
| 5,020,416 | 6/1991 | Tripp | 89/14.3 |
| 5,279,200 | 1/1994 | Rose | 89/14.3 |
| 5,305,677 | 4/1994 | Kleinguenther et al. | 89/14.2 |
| 5,631,438 | 5/1997 | Martel | 89/14.3 |

*Primary Examiner*—Charles T. Jordan
*Assistant Examiner*—Meena Chelliah

[57] ABSTRACT

The gun barrel stabilizer system of the present invention increases or optimizes the accuracy of guns including small arms and artillery. The invention consists of a device called a gun barrel stabilizer rigidly attached at the gun muzzle, and extending toward the gun breech, without further contact with the gun barrel or other gun components. The device responds to the same forces which cause recoil motion and, by virtue of its cantilever nature, resists angular deflection of the gun muzzle during firing. The stabilizer system, in an optimized state, serves to maintain the final segment of the gun barrel at the muzzle moving though a locus of parallel positions up to the time of projectile release. In the absence of angular deflection at the muzzle, gun accuracy is increased to a maximum allowed by the remaining limitations of cartridge performance and barrel bore quality. Preferred embodiments provide for the combination of the device with gun sights, muzzle brakes, compensators, counterweights, bayonet lugs, and/or flash suppressors including accommodation for the added mass resulting from the combination. Preferred embodiments additionally provide for various modes of attachment of the invention to gun barrels.

22 Claims, 12 Drawing Sheets

GUN BARREL STABILIZER

BACKGROUND OF THE INVENTION

1. Field

This invention relates to guns including: small arms such as rifles, handguns, machine guns, air rifles; and artillery. It particularly relates to systems including weight devices which attach to the muzzle end of gun barrels for increasing the accuracy of guns. It is directed to muzzle brakes and compensators which attach to gun barrel muzzles and channel discharged propellent gases in directions other than axially as the projectile departs the gun bore in order to reduce muzzle rise and/or recoil. It is also directed to flash suppressors which diffuse released propellent gases thereby lessening the visible flash. Gun sights and bayonet lugs are also involved.

2. State of the Art in Accuracy Improvements

Accuracy as it relates to guns, is defined as the ability of the gun to cause a projectile to arrive at or near to an intended location some distance from the gun. A gun which can deliver its projectiles consistently closer to that location is said to be more accurate. Accuracy is clearly a desirable attribute of a gun since the energy of the projectile can only be put to use effectively if the projectile can be brought to the intended target.

Inaccuracy results primarily from angular deflection of the paths of a plurality of projectiles from the average path of the projectiles as a group, given that the aiming point is the same. In earlier times, much of this angular deflection was caused by deflection of the projectile itself after it left the gun muzzle. Poor projectile shape, plus mass and shape eccentricity caused by fabrication technique or deformation during firing, were accuracy reducing influences. Addition of rifling in gun bores to impart stabilizing spin to the projectiles allowed the use of improved shapes. Self-contained cartridges combined with successful breech loading systems were developed. Stronger projectiles with jackets of copper or other materials resulted in greater resistance to deformation during firing. Other improvements included smoother gun bore surfaces of very uniform dimensions closely matching the diameter of the projectiles and better gun chamber dimensional control resulting in close alignment of the projectile with the bore. Concentricity and uniformity in cartridges has also been greatly improved over time.

All of the above advances have reduced the angular deflection of projectiles after they depart the muzzle leaving variations in angular deflection of the muzzle itself during firing as a significant negative influence on the accuracy of guns. Angular deflection results from the forces generated during firing. A number of factors acting in conjunction with the forces generated during firing produce effects acting perpendicular to the gun bore. Some factors include uneven bearing of the cartridge case on the bolt face due to cartridge or bolt irregularities, uneven bearing of bolt locking lugs on receiver mating surfaces, asymmetric flexing of the receiver under the loads of firing due to asymmetry of the receiver, and inconsistent interferences between the gun and supporting structures to include the shooter, in the case of small arms, or the gun carriage in the case of artillery. However, the most common single factor producing force components acting perpendicular to the gun bore results from the fact that the mass center or center of gravity of the gun, including all attachments, is not normally located concentric with the axis of the gun bore. The forces produced by the pressure of the propellent gases act rearward along the axis of the gun bore.

These forces are resisted by the mass of the gun but because the mass center is offset from the bore, a couple results, thereby producing accelerations of the gun barrel in directions perpendicular to the axis of the bore. These perpendicular accelerations, acting along the unsupported sections of the gun barrel are resisted by the mass of the gun barrel causing temporary elastic bending of the gun barrel, and angular deflection of the final segment of gun barrel adjacent to its distal end. This final segment of barrel is called the muzzle. The development of these forces which produce gun muzzle angular deflection increase and diminish in very short periods of time, on the order of one millisecond for modern high powered rifles, as the pressure inside the gun cartridge increases to a peak and then declines as the projectile moves further down the gun barrel to be finally released as the projectile leaves the muzzle. The bending of the gun barrel is, therefore, also a transient event resulting in changes in the amount of bending over the very short time period while the projectile is in the barrel. Small variables, which may include such things as changes in the pressure profile and/or drag of the projectile inside the barrel from shot to shot, tend to change the timing of projectile departure relative to the angular position of the muzzle. This in turn results in dispersion of projectile impacts at the target.

The prior art applies two primary techniques to mitigate the negative effects of angular deflection in the muzzles of guns during firing. The first technique consists of increasing the section modulus of gun barrels thereby reducing the magnitude of deflection under perpendicular accelerations. This is usually achieved by simply increasing the outside diameter of the gun barrel, although fluted or sleeved barrels are sometimes used. The second technique consists of adding a small fixed or adjustable weight to the end of the gun barrel placed in such a position to cause a period of reduced rate of angular deflection at the muzzle to coincide with the average time of projectile exit. Both of these techniques have drawbacks and limitations. Fluted and sleeved barrels are usually heavier than their conventional counterparts of the same length. Larger diameter barrels are always heavier. Barrel weights can only be correctly positioned or "tuned" empirically and also typically perform best with only one cartridge loading condition. Retuning is required for any change in cartridge or cartridge components including changes in brand, bullet type, weight, or powder charge. Further, both of these techniques can only reduce, but not eliminate, angular deflection of gun muzzles. Since some variation in the timing of projectile release will always remain, these techniques cannot filly optimize the accuracy of guns.

State of the Art in Recoil and Muzzle Rise Reduction

Gas pressure released by the ignition of the powder in a gun cartridge acts on the base of the projectile to propel it along the bore of the gun. This same gas pressure acts on the breech mechanism of the gun to produce a recoil force and motion. As has been previously explained, this force acts along the axis of the gun bore to produce not only rearward acceleration of the gun, but also perpendicular accelerations on the gun barrel. Since the mass center of the typical gun is below the axis of the bore, the acceleration of the gun barrel is generally upward. Propellent gases also act to increase recoil if their mass is allowed to exit the gun barrel along the axis of the bore. Both muzzle brakes and compensators serve to redirect the propellent gases from their path along the axis of the gun barrel and, therefore, reduce recoil. A number of devices have been developed as attachments to the muzzles of guns to reduce recoil and muzzle rise. Today, devices which redirect propellent gases to reduce the recoil of guns are called muzzle brakes, although any device which reduces recoil force may also reduce muzzle rise. Those devices which intentionally direct more of the gases upward to reduce muzzle rise are usually called compensators. A great many variations of muzzle brakes and compensators exist, however, they have some common characteristics. They are all attached to or are made integral with the gun barrel distal end. They include one or more chambers with a diameter significantly larger than the projectile. Most all include one or more baffles of a diameter smaller than the chamber or chambers but still larger than the projectile, which serve to isolate the chambers and baffle the flow of propellent gases from continued motion in the direction of the projectile. Compensators are characterized by a hole or holes which penetrate into the chamber or chambers and which serve to direct propellent gases upward or upward and backward. The jetting effect of these gases serve to create a downward or downward and forward force which lessens both muzzle rise and recoil. In the case of muzzle brakes, the holes are arranged in opposing pairs or around the full perimeter of the chambers. Muzzle brakes release the propellent gases, thereby lessening the recoil, but do not generally use the jetting force deliberately to reduce muzzle rise. Muzzle brakes and compensators are not normally considered accurizing devices because they act only after the projectile has left the barrel. They do, however, constitute a small added mass which, when properly positioned on the barrel, can serve to improve accuracy as has previously been described. This is the case with the Ballistic Optimizing System (U.S. Pat. No. 5,279,200) which incorporates a muzzle brake with position adjustment features so it can be used also as an accuracy tuning mass.

State of the Art in Flash Suppression

Propellent gases, when they exit the muzzles of guns, are at high temperature producing light well into the visible range. In military applications this has the undesirable effect of alerting the enemy to a soldier's position, particularly when he must fire his weapon in darkness. A variety of devices have been developed to lessen the appearance of what has come to be called "muzzle flash". The most common devices are referred to as flash suppressors and are similar to muzzle brakes previously described, but generally lack the internal chamber or chambers and have longitudinal slots rather than holes to redirect propellent gases. They are designed with the primary intent of rapidly diffusing the propellent gases and thereby lessening the visible muzzle flash. Representative examples include the flash suppressors mounted on the U.S. M14 and M16 rifles, and the U.S. M60 machine gun. Bayonet lugs for attaching bayonets to rifles are often found in combined use with flash suppressors.

State of the Art in Gun Sight Technology.

Guns, to include: handguns, rifles, machine guns, air rifles and artillery, require sighting systems. Telescopic sights, mounted most often to small arms receivers, do not require front or forward sights, or aiming reference to be aligned with a rear sight. Metallic sighting systems for small arms do include sights which often require mounting or other interface accommodation on or near the gun barrel distal end. Modem artillery seldom if ever use two part metallic gun sight systems and, therefore, have no interface accommodation or other devices for sight mounting at or near the gun barrel distal end. Metallic sighting systems may be fixed or incorporate means to easily accomplish adjustment. Telescopic sighting systems almost always incorporate means to easily accomplish adjustment.

Summary of the Invention

The gun barrel stabilizer system of the present invention is for the purpose of increasing or optimizing the accuracy of guns including small arms and artillery. The invention consists of a device called a gun barrel stabilizer rigidly attached at the gun muzzle and extending toward the gun breech without further contact with the gun barrel. The shape of the device and the method of attachment must serve to prevent contact with the barrel or other gun components behind the gun barrel distal end attachment point during firing. The device, in its optimized state, serves to maintain the final segment of the gun barrel at the muzzle moving though a locus of parallel positions, under perpendicular acceleration, up to the time of projectile release. In the absence of angular deflection at the muzzle, gun accuracy is increased to a maximum allowed by the remaining limitations of cartridge performance and barrel bore quality. Preferred embodiments provide for the combination of the stabilizer with gun sights, muzzle brakes, compensators and/or flash suppressors including accommodation for added mass resulting from the combination. Preferred embodiments additionally provided for various modes of attachment of the device to gun barrels.

FIG. 5 presents a simplified representation of a hypothetical gun shown with its barrel deflected as it might be during firing. This deflection is shown greatly exaggerated for the purpose of illustrating the condition addressed by the present invention. FIG. 6 presents the same hypothetical gun with the present invention installed. In this case, a stabilizer is joined to the gun barrel with a transition piece. Such transition pieces may be integral or comprise a separate component joined to the stabilizer. Based on the attachment at the gun muzzle, and by the cantilevered nature of its extension rearward from the muzzle, the present invention, when exposed to the same acceleration as the barrel, resists the angular deflection of the muzzle. Instantaneous rates of change in angular position of the muzzle are reduced, therefore, variations in the timing of bullet release will have less effect and accuracy will be increased.

If a gun has some transition point along its barrel from a condition of relatively low section modulus to a condition of relatively high section modulus, and the natural frequency of the barrel forward of this point has a natural frequency sufficiently lower than the segment behind this point, then the forward segment of barrel can be assumed "uncoupled" from the remainder of the gun. This point is then taken as an anchor point within a frame of reference moving with the gun under recoil. Beam bending theory is then applied to the barrel forward segment and to the application specific embodiment design of the present invention. Beam bending moment equations which are familiar to all mechanical and structural engineers can be selected and combined, using such techniques as superposition to develop simple models of the bending behavior of the barrel and various versions of the present invention proposed for use in the application at hand. Typical examples of these moment equations are found on pages 100 through 112 of Warren C. Young, *Roark's Formulas for Stress and Strain*, 6th ed. (McGraw-Hill, Inc. 1989). The key concept requires setting the moment necessary to maintain the gun muzzle moving through a locus of parallel positions, equal in magnitude to the moment that the specific embodiment must provide. In this way the actual magnitude of the moments need not be known because the resulting equations contain only the stabilizer dimensions as variables. A barrel stabilizer system can be designed by selecting all dimensions but one. For example, dimensions could be chosen to match commonly available material shapes, desired features such as a muzzle brake, and/or styling objectives, leaving a last dimension, like stabilizer length, as a dependent variable.

It must be recognized that these simple models which use beam bending formulas directly assume linear acceleration fields. Stabilizers designed in this way can provide significant improvements in accuracy, but are typically not capable of optimizing performance. Actual accelerations are most likely to be angular. Improved analytical models are produced by accounting for rotational motion about the center of gravity of the gun. One method of improved model development uses the beam bending equations previously cited but modifies the resulting forces to make them proportional to their radial location outward from the gun's center of gravity. Complete elimination of muzzle angular deflection is possible, given that a configuration of the specific embodiment can be developed which provides a counteracting bending moment exactly matching the bending moment required to maintain the barrel moving through a locus of parallel positions during firing. In this optimized state, variations in bullet exit timing can no longer influence the projectile angular dispersion and maximum accuracy will be achieved.

Development of prototype stabilizers has shown that there is also a relationship between the natural frequency (or period of motion) of the combined barrel segment and stabilizer system, and the time period that the projectile is in the gun barrel during firing. If much more than the first half of the first cycle of vibration can take place before the bullet departs the muzzle, then there is increasing opportunity for the barrel motion and stabilizer motion to become unsynchronized. It is suspected that this occurs due to deviations from the ideal state of exactly matching moments as described above. For most modern high powered rifles, performance difficulties are likely to occur if the natural frequency of the combined barrel segment and stabilizer exceeds about 500 cycles per second. Simple equations of vibration, such as the one found on page 5–70 of Eugene A. Avallone and Theodore Baumeister III, *Marks' Standard Handbook for Mechanical Engineers*, 9th ed., (McGraw-Hill, Inc., 1987), have been effective in approximating natural frequency for this evaluation. Reducing the barrel end segment diameter, increasing the barrel segment length, or increasing the mass of the stabilizer are all methods to reduce the natural frequency. If these options are not available, then very precise matching of moments must be achieved, possibly requiring fine tuning of stabilizer dimensions through empirical methods involving adjustable counterweight systems.

It is important to note that changes to different cartridge configurations will not require any retuning of the specific optimized embodiment to achieve best accuracy because the invention in the optimized condition is not sensitive to changes in projectile exit timing which might be caused by cartridge configuration. This allows the gun user much greater flexibility in the selection of cartridge components for specialized applications without loss of accuracy.

Much effort is expended to minimize or eliminate factors acting during firing which produce forces perpendicular to the gun bore. Sometimes this effort is expended in the initial manufacturing process and in other cases, it involves addition of aftermarket components and changes. Examples include receiver bedding, receiver truing, receiver sleeving, and bolt locking lug hand fitting. Most or all of this cost increasing effort could be eliminated with use of the subject invention which eliminates the negative accuracy effects of all perpendicular forces when employed in its optimized state. (It must be noted that the present invention cannot correct for shot to shot variations in the relative alignment of the barrel with the sighting system which is sometimes the case with gun actions which are loose to move within mounts or stocks.)

Establishment of a point of transition on a gun barrel, from a condition of relatively low section modulus to a condition of relatively high section modulus, is desirable and assists in the design of optimized embodiments. This change from lower to higher section modulus should be of such a magnitude to separate the natural frequency of vibration of the barrel segment near the muzzle from the natural frequency of the remainder of the barrel and gun, or in other words, "uncouple" the muzzle section from the remainder of the gun. These points of transition are already inherent in the configuration of many guns in current production. Examples include the point of contact between a rifle barrel and forward barrel supports in the rifle stock barrel channel, barrel bands which clamp barrels to gun stocks, and points of attachment for the gas systems of automatic and semiautomatic guns which add stiffness to their barrels. In the absence of these points of transition, or for other reasons of style or design, a point of transition from a condition of relatively low section modulus to a condition of relatively high section modulus is added to the gun barrel at a location removed rearward from the muzzle.

The present invention provides some very important benefits to the designer of specific embodiments which greatly eases the design process. The design of each specific embodiment is dependent only on the parameters found in moment equations. It is, therefore, unnecessary to determine the modulus of elasticity or the area moment of inertia. It is not necessary to know the magnitude of the accelerations imposed on the gun because the resulting moments can be considered relative in the equations used for sizing the specific optimized embodiment. It is also not necessary to know the direction of the acceleration perpendicular to the barrel provided the embodiment has arrangement of its mass largely or completely concentric with the gun bore as is achieved in cylindrical designs. This arrangement of concentric mass includes any sight system, muzzle brake, compensator and/or flash suppressor as part of the embodiment. The dimensions of any optimized embodiment is dependent only on the dimensions and material densities of the gun barrel and the chosen materials of the barrel stabilizing device.

Various types of steel will be the common material of construction, however, specific embodiments of the present invention can use different materials or combinations of materials provided elastic properties are compatible with imposed loads. The shapes of the designed embodiments are not particularly constrained other than as discussed above and which provide sufficient clearance to preclude contact during firing between the stabilizer and other gun components behind the muzzle. Simple uniform cylindrical sleeves to all manner of cross section shapes are used as necessary to meet manufacturing, interface and styling objectives, as well as to accommodate added features including: sights, adjustable counterweight systems, muzzle brakes, compensators, flash suppressors, and bayonet lugs. Various attachment systems are used alone or in combination with one or more of the above listed features to form embodiments of the subject invention. Systems for attaching stabilizers to barrels include: threaded and lock nut systems including those with conical interfaces and/or other alignment features, clamping systems, collet clamping systems, pinned systems incorporating single or multiple pins, and bonded attachments using bonding materials including braze, solder, or polymer adhesives such as Locktite ® 609 which are compatible with the forces and temperatures of gun use.

DETAILED DESCRIPTION OF THE INVENTION

Figure 1:
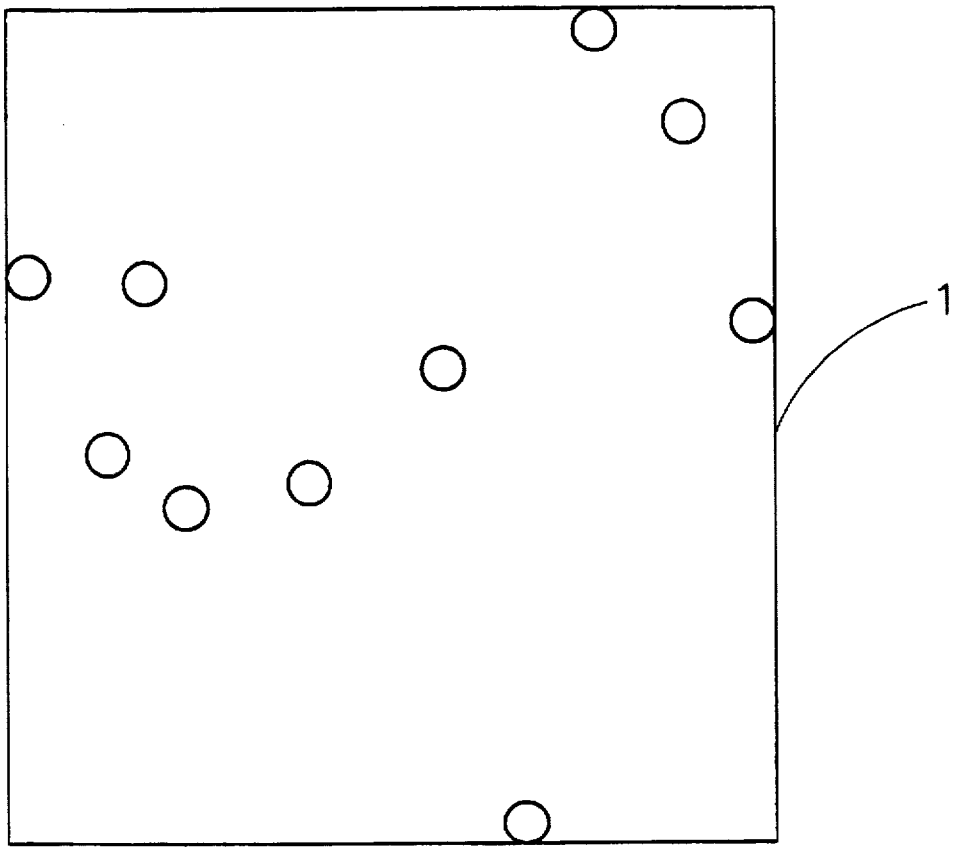
Figure 1. (PRIOR ART)
FIG. 1 is a pictorial reproduction of a group of bullet holes on a test target as actually fired upon with an unmodified rifle.
Figure 2A:
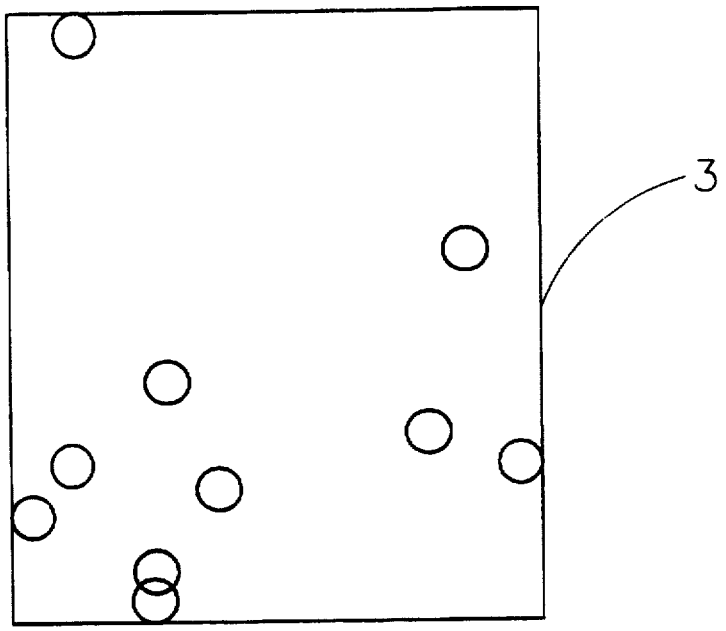
Figure 2A. (PRIOR ART)
FIG. 2A is a pictorial reproduction of a group fired with the same rifle incorporating standard accurizing modifications.
Figure 2B:
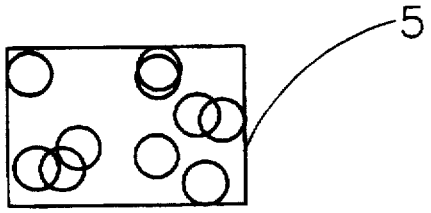
FIG. 2B is a pictorial reproduction of a group fired with the same rifle incorporating standard accurizing modifications and equipped with a barrel stabilizer system of the present invention.
Figure 3A:
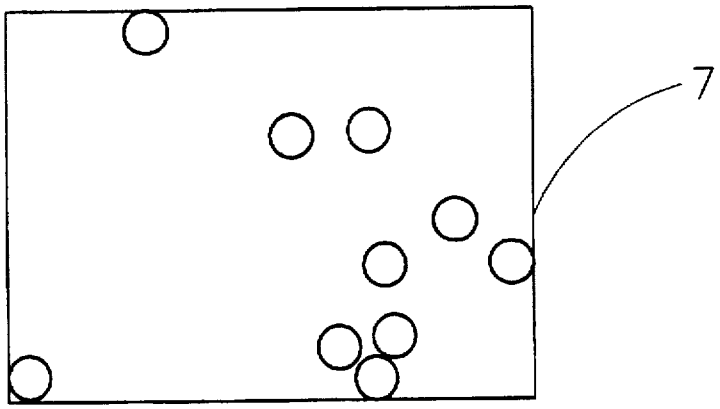
Figure 3A. (PRIOR ART)
FIG. 3A is a reproduction like FIG. 2A, showing a group fired with the same rifle incorporating standard accurizing modifications but with a second brand and type of ammunition.
Figure 3B:
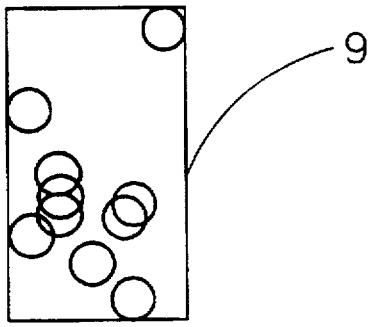
FIG. 3B is a reproduction like FIG. 2B, showing a group fired with the same rifle incorporating standard accurizing modifications and with the same second brand and type of ammunition, further equipped with the same barrel stabilizer system of the present invention.
Figure 4A:
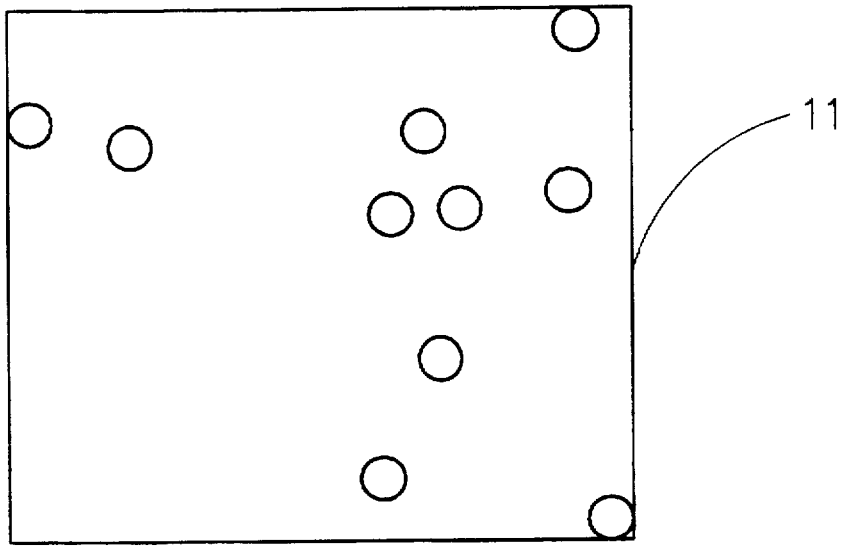
Figure 4A. (PRIOR ART)
FIG. 4A is a reproduction like FIG. 2A, showing a group fired with the same rifle incorporating standard accurizing modifications but with a third brand and type of ammunition.
Figure 4B:
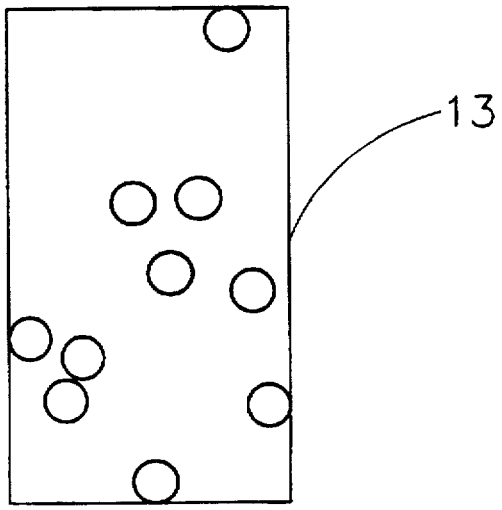
FIG. 4B is a reproduction like FIG. 2B, showing a group fired with the same rifle incorporating standard accurizing modifications and with the same third brand and type of ammunition, further equipped with the same barrel stabilizer system of the present invention.

FIGS. 1, 2A, 2B, 3A, 3B, 4A, and 4B depict typical groups of bullet holes resulting from test firing of a Ruger caliber .223 Mini-14 with Leupold 8× telescopic sight installed. All firing was done from a bench rest at a range of 100 yards and with 10 round groups. The figures were created by first digitizing the location of each bullet hole on test targets, entering the data in a computer, and then reproducing the pattern of holes at full scale with exact bullet diameter circles. Each group was then enclosed in a rectangle drawn tangent to the widest vertical and horizontal bullet holes in the group. The group in FIG. 1 indicated at 1 was fired using Hornady Varmint Express 55 grain factory ammunition with the rifle in unmodified configuration. The group shown in FIG. 2A indicated at 3 was fired using the same type of Hornady ammunition with the rifle incorporating standard accuracy modifications commonly employed on U.S. M14 rifles, including polymer bedding of the rifle action. Incorporation of standard accuracy modifications were done to prevent looseness of the gun action within its stock. The group shown on FIG. 2B indicated at 5 was fired using the same type of Hornady ammunition with above mentioned accuracy modifications plus an optimized barrel stabilizer system of the present invention installed. The change between the group on FIG. 1 indicated at 1 to the group on FIG. 2A indicated at 3 constitutes a modest reduction in extreme spread by less than 25%. The change, between the group on FIG. 2A at 3 and the group on FIG. 2B at 5, constitutes at dramatic reduction by nearly a factor of three in extreme spread. The groups depicted in FIGS. 3A, 3B, 4A, and 4B were fired with the Ruger rifle with above mentioned accuracy modifications first without (on FIG. 3A at 7 and FIG. 4A at 11) and then with (on FIG. 3B at 9 and FIG. 4B at 13) the same barrel stabilizer system of the present invention. Groups depicted in FIGS. 3A and 3B were fired with Winchester 69 grain Match ammunition. Groups depicted in FIGS. 4A and 4B were fired with ammunition representative of recent U.S. Military 55 grain Ball ammunition. FIGS. 3A, 3B, 4A, and 4B show that the stabilizers of the present invention achieve accuracy improvement for all ammunition compatible with a given gun without change or adjustment of the stabilizer. The groups depicted in FIGS. 1, 2A, 2B, 3A, 3B, 4A, and 4B were not selected to exaggerate the performance of the present invention but rather represent typical performance of the configuration under test as described above. Accuracy improvement in this Ruger rifle has been found typical for guns of various types after installation of the present invention. The minimum reduction in group size for any gun, so far equipped with an optimized barrel stabilizer system of the present invention, was 50% and occurred with a rifle already possessing excellent accuracy. A factor of five was the maximum reduction in average group size for guns under test during development of the subject invention. With the exception of the Ruger Rifle described above, all rifles tested after installation of optimized barrel stabilizer systems of the present invention produced average ten shot groups measuring under one minute of angle for center to center for extreme spread on the widest holes.

Figure 5:
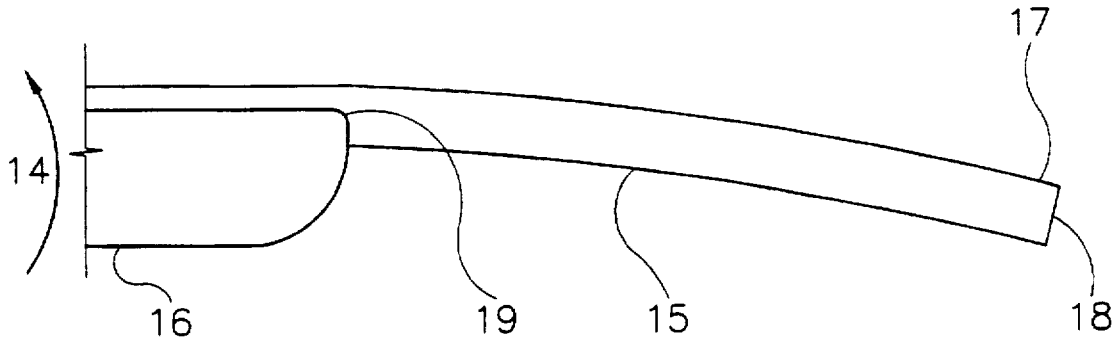
FIG. 5 is a side elevation view of a hypothetical gun showing an exaggerated representation of barrel muzzle angular deflection during firing.

The forward portion of a model gun is shown in FIG. 5 responding to the forces, represented at 14, generated by firing. The depicted forward portion of the gun consists of the barrel 15, the forestock 16, the muzzle 17 with distal end 18, and a contact point 19 with the barrel at the forward end of said forestock 16. The barrel 15 including the muzzle 17 is shown with exaggerated angular deflection for the purposes of illustration.

Figure 6:
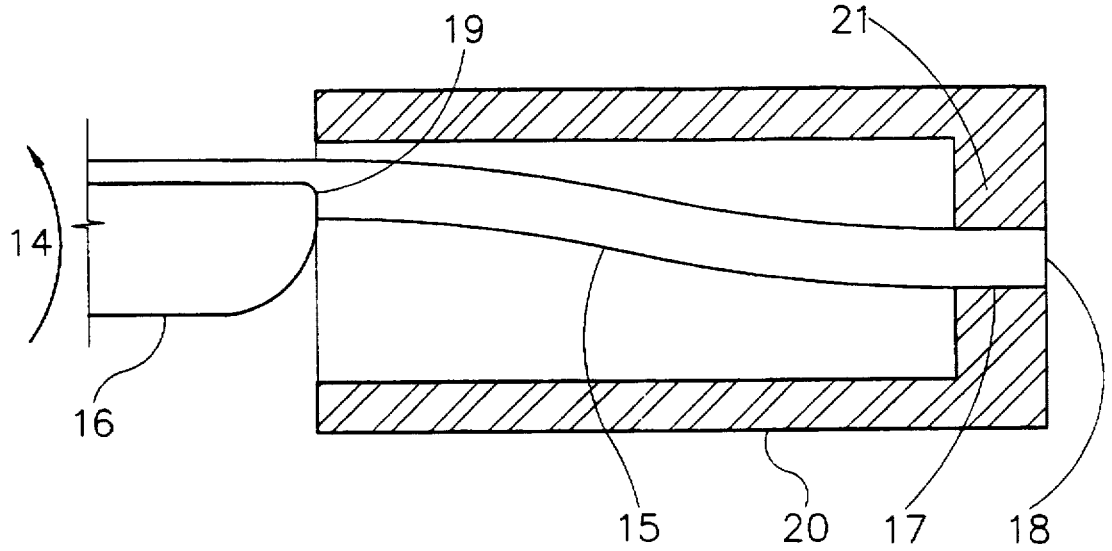
FIG. 6 is a side elevation view of the gun of FIG. 5 presenting am exaggerated representation of a barrel stabilizer system of the present invention, shown in section, installed and resisting the barrel muzzle angular deflection during firing.

FIG. 6 depicts the same gun of FIG. 5 now shown with the system of the invention, including a stabilizer indicated generally at 20 greatly exaggerated for purposes of illustration. A transition piece shown generally at 21 joins the stabilizer 20 to the barrel 15 at the muzzle 17. The stabilizer 20 is shown resisting and correcting the angular deflection of the muzzle 17 by virtue of its cantilever nature, extending rearwards from the barrel muzzle 17, when exposed to the same forces 14 generated by firing. The stabilizer 20 is shown extending rearward from the distal end 18 of the barrel 15 to the contact point 19 between the forestock 16 and the barrel 15. The contact point 19 is a point of transition from relatively low section modulus to relatively high section modulus. Optimized embodiments of the present invention will have barrel stabilizer systems which extend rearward from gun muzzles to positions short of, beyond, or to such points, based on the configuration of the gun and desired appearance and features of the stabilizer.

Figure 7:
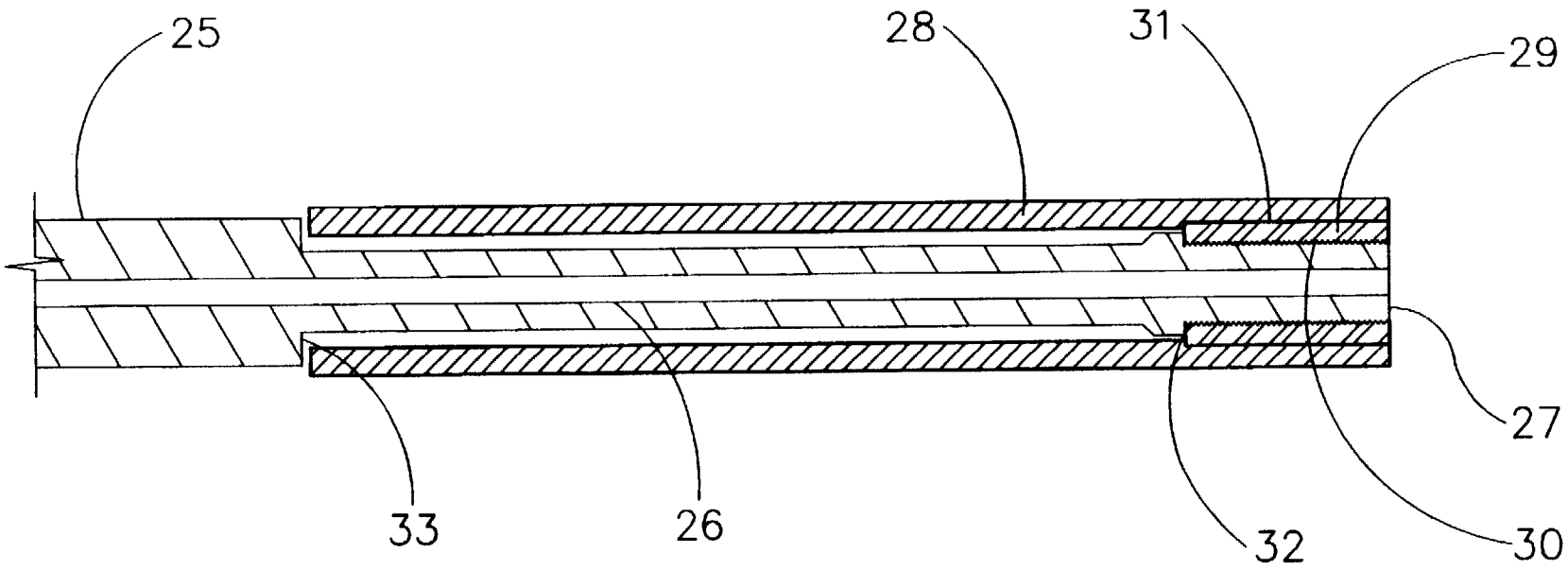
FIG. 7 is a side elevation sectional view of a first preferred embodiment of the present invention installed on a rifle barrel and showing threaded attachment.

FIG. 7 depicts a first preferred embodiment including a segment of rifle barrel shown generally at 25 including barrel bore 26 and distal end 27. A tubular stabilizer 28 is shown installed via a transition piece 29 using internal threads which cooperate with external threads on the barrel at 30. The transition piece 29 is joined to the stabilizer 28 by interference fit at 31. The stabilizer 28 is held in position through contact between the transition piece 29 and a shoulder on the barrel at 32. The stabilizer 28 extends rearward from the distal end 27 almost to a point of transition 33 on the rifle barrel 25 from smaller diameter to larger diameter. Point 33 serves as the transition from relatively low section modulus to relatively high section modulus.

Figure 8:
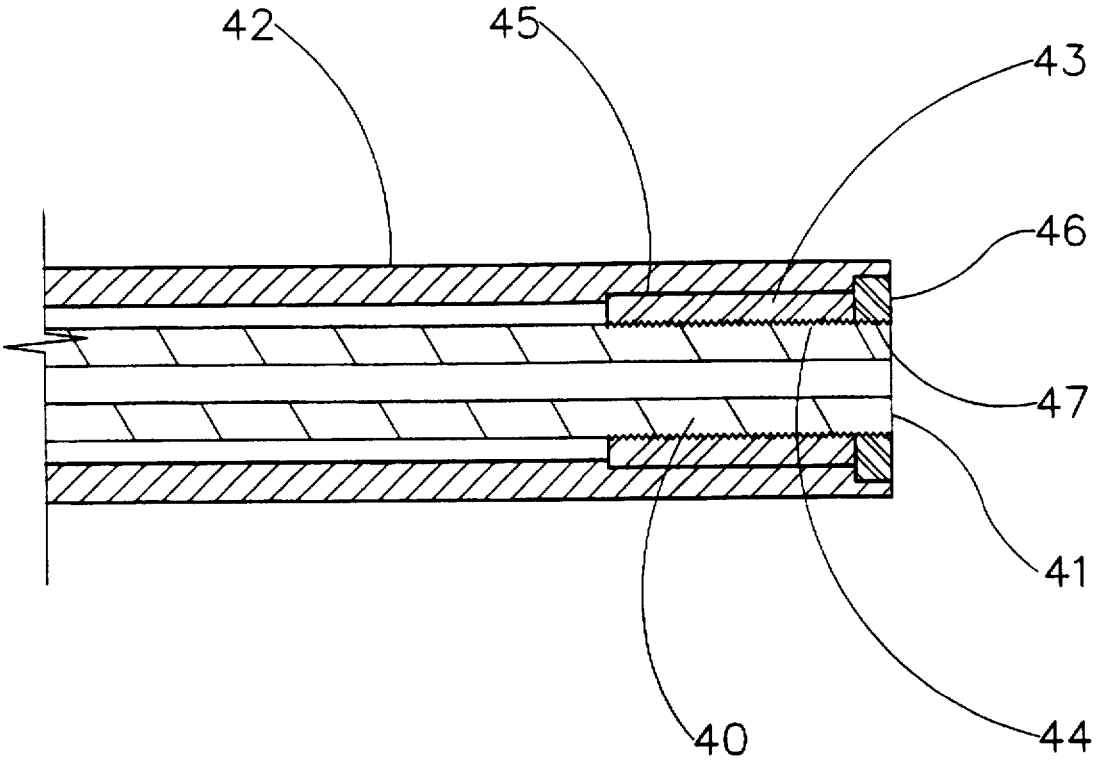
FIG. 8 is a view like that of FIG. 7 showing details of a second preferred embodiment of the present invention installed on an air rifle barrel using threaded attachment and threaded lock nut.

FIG. 8 depicts the attachment details of a second preferred embodiment similar to that shown in FIG. 7 including a segment of an air rifle barrel shown generally at 40 including distal end 41. A tubular stabilizer 42 is shown installed via a transition piece 43 using internal threads which cooperate with external threads on the barrel at 44. The transition piece 43 is joined to the stabilizer 42 by bonded attachment at 45. The stabilizer 42 is secured to the barrel 40 through contact with a lock nut 46 incorporating internal threads which cooperate with external threads on the barrel at 47.

Figure 9:
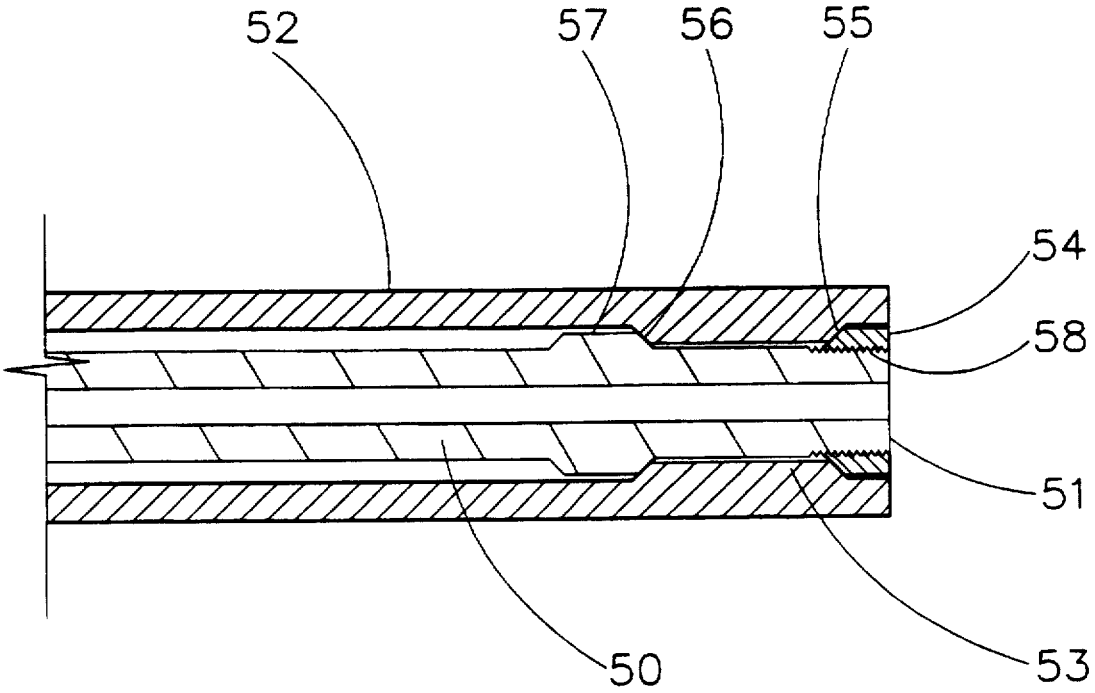
FIG. 9 is a view like that of FIG. 7 showing details of a third preferred embodiment of the present invention installed on a rifle barrel using tapered shoulders and a tapered lock nut.

FIG. 9 depicts the attachment details of a third preferred embodiment similar to that shown in FIG. 7 including a segment of rifle barrel shown generally at 50 including distal end 51. A tubular stabilizer 52 incorporates an integral transition piece shown generally at 53. The stabilizer 52 is connected to the barrel by a lock nut 54 with a conical interface shown at 55 on the transition piece 53. The transition piece 53 further cooperates with a second conical interface 56 on an enlarged segment of barrel shown at 57. Internal threads on the lock nut 54 engage external threads on the barrel at 58. Close alignment is maintained by the conical interfaces shown at 55 and 56, and is repeatable should the stabilizer 52 be removed from the barrel 50.

Figure 10:
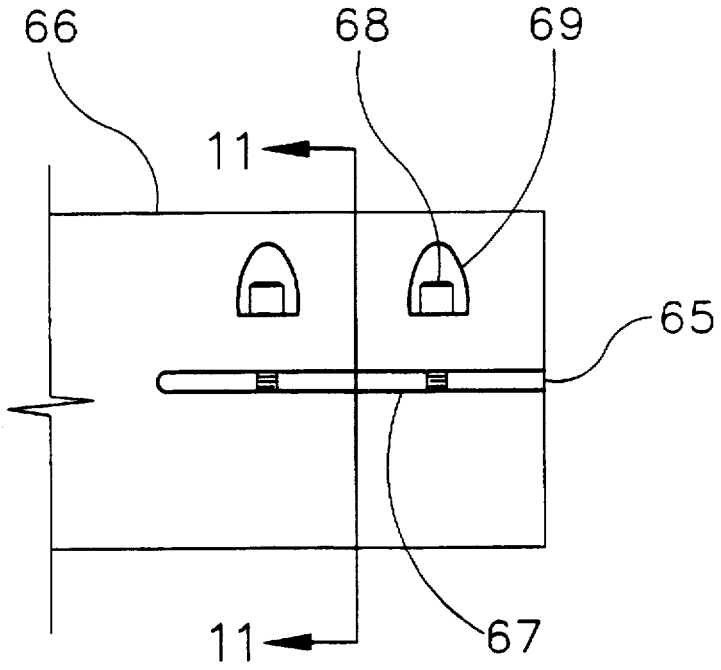
FIG. 10 is a side elevation view showing clamping system attachment details of a fourth preferred embodiment of the present invention installed on a rifle barrel using a split section and clamping screws.

FIG. 10 depicts the attachment details of a fourth preferred embodiment similar to that shown in FIG. 9 including a segment of rifle barrel distal end 65. A tubular barrel stabilizer 66 incorporates a horizontal slot 67 that bisects stabilizer 66 in the region where stabilizer 66 contacts the barrel. The slot 67 cooperates with clamping screws shown typically at 68 to produce a clamping force attaching the stabilizer 66 to the barrel. Relief cuts shown typically at 69 accommodate the clamping screws.

Figure 11:
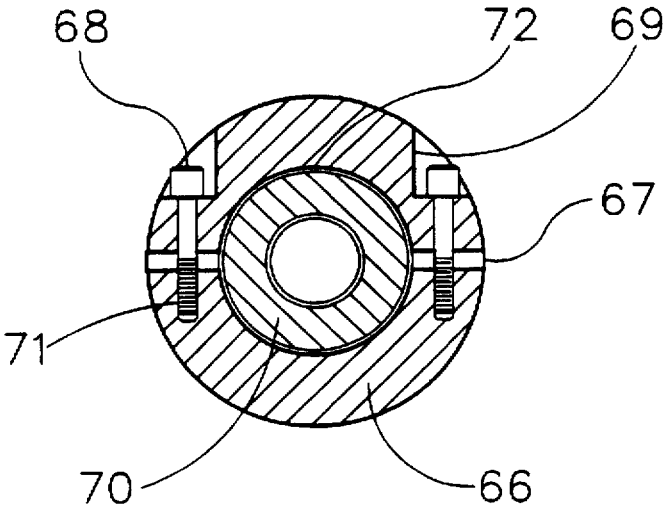
FIG. 11 is a cross section view taken along lines 11—11 of FIG. 10, showing details of the clamping screw installation.

FIG. 11 depicts a cross section view of FIG. 10 with the gun barrel shown at 70. The stabilizer, including integral transition piece, is shown generally at 66. External threads, on the clamping screws shown at 68, cooperate with internal threads in the stabilizer at 71, and with slot 67, to produce a clamping force at the stabilizer-barrel interface shown generally at 72.

Figure 12:
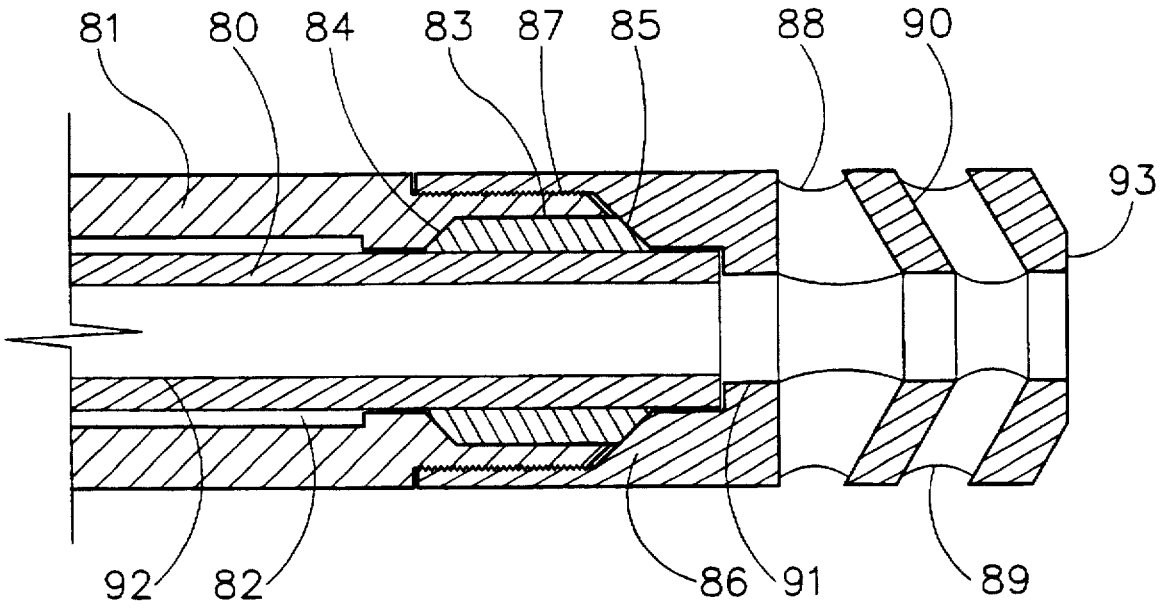
FIG. 12 is a top sectional view showing attachment details of a fifth preferred embodiment of the present invention incorporating a muzzle brake, installed on an artillery barrel using a collet clamping attachment.

FIG. 12 depicts the attachment details of a fifth preferred embodiment similar to that shown in FIG. 7 including a segment of artillery barrel shown generally at 80. A tubular stabilizer 81 is shown with clearance space 82. The stabilizer 81 is connected to the barrel by a clamping collet 83 with conical interfaces shown at 84 and 85. The clamping collet 83 forms the transition from the stabilizer 81 to the barrel 80. A lock nut including integral muzzle brake shown generally at 86 incorporates internal threads which cooperate with external threads on the stabilizer at 87 to capture and compress the clamping collet 83 onto the barrel 80. The lock nut incorporating integral muzzle brake 86 includes two pairs of opposing vent holes shown typically at 88 and 89, plus internal baffles shown generally at 90. The lock nut incorporating integral muzzle brake further includes a central bore 91 larger than the gun bore 92, and distal end shown at 93.

Figure 13:
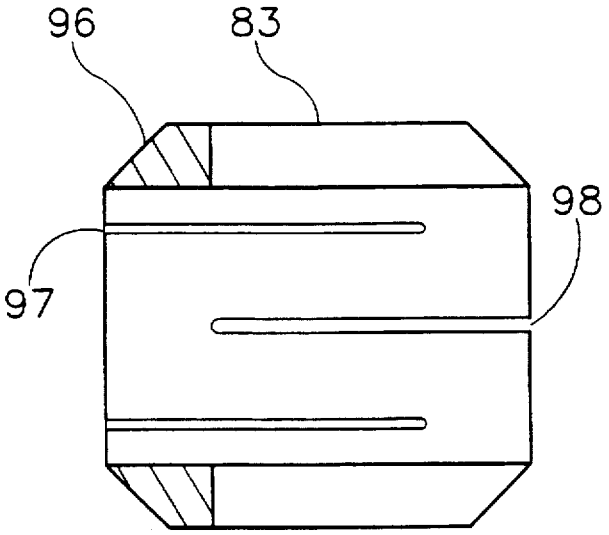
FIG. 13 is a enlarged section view of the clamping collet of FIG. 12.

FIG. 13 shows an enlarged detail of the clamping collet 83 from FIG. 12 including conical surfaces shown typically at 96. Multiple longitudinal slots shown typically at 97 and 98 extend from opposite ends of the clamping collet 83 accommodating the flexibility necessary for the clamping collet 83 to perform its function.

Figure 14:
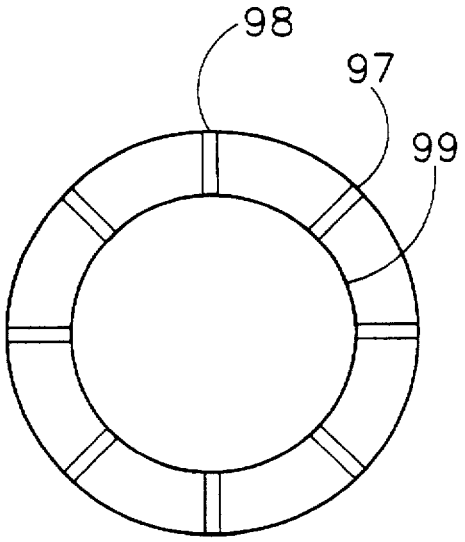
FIG. 14 is an end view of the collet of FIG. 13.

FIG. 14 is an end view of the clamping collet 83 of FIG. 13 including longitudinal slots shown typically at 97 and 98 plus central bore 99 matching the artillery barrel outside diameter.

Figure 15:
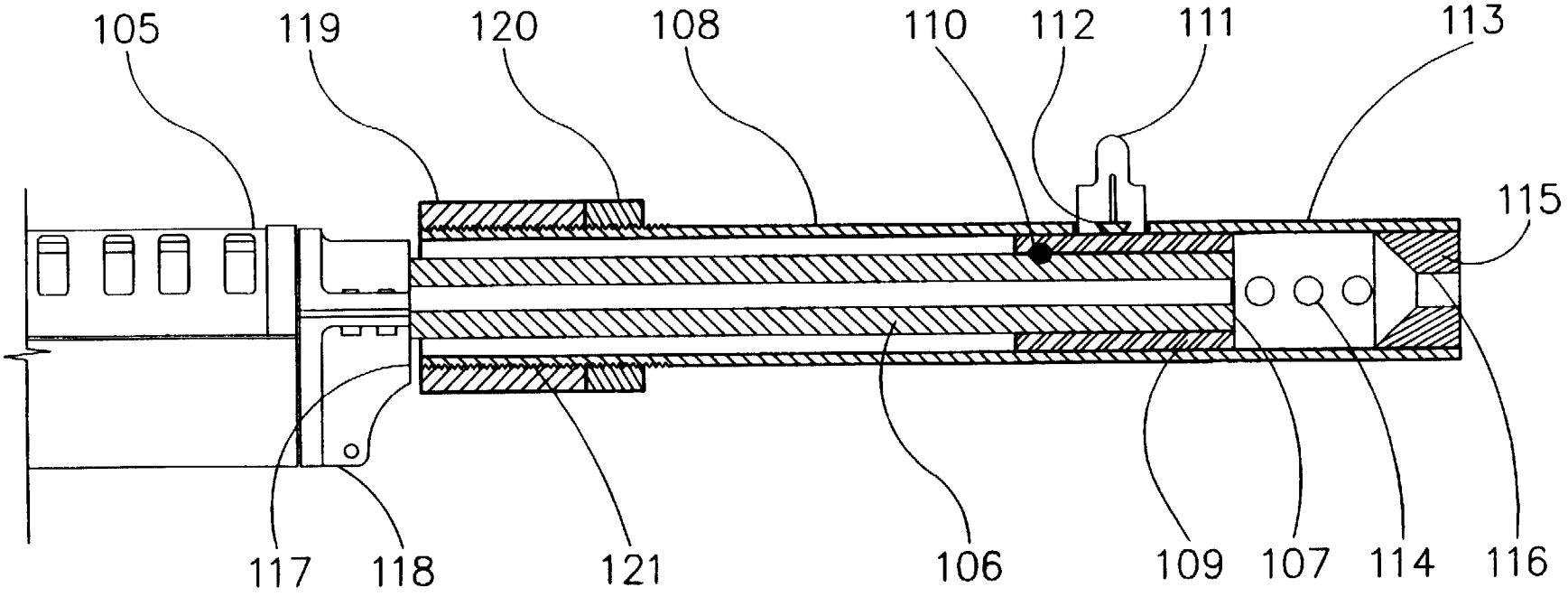
FIG. 15 is a partial side sectional view of the forward components of a Ruger Mini-14 rifle with a sixth preferred embodiment of the present invention installed incorporating pinned attachment, muzzle brake, front sight, and adjustable counterweight.

FIG. 15 depicts a sixth preferred embodiment including the forward segment of a Ruger Mini-14 .223 caliber rifle, shown generally at 105, including the forward section of barrel 106 with distal end 107. A tubular stabilizer 108 is shown installed via a transition piece 109 which is bonded inside the stabilizer 108. A retaining pin 110 is installed by interference fit into a hole which passes thought the stabilizer 108, transition piece 109, and barrel 106, centered on a cord line which is tangent to the transition piece and barrel interface diameter. The pin 110 serves to lock the stabilizer 108 to the barrel 106 against rotation and axial movement. The stabilizer 108 is shown with a front sight 111 installed to a sight base 112. The stabilizer 108 extends forward beyond the distal end of the barrel 107 to form the outer casing of a muzzle brake at 113 including vent holes shown typically at 114. The muzzle brake system further includes a baffle piece 115 with central bore 116 installed by bonded connection inside the muzzle brake casing 113. The stabilizer 108 extends rearward from the distal end of the barrel at 107 almost to a point of transition 117 on the rifle barrel 106 resulting from the presence of the Mini-14 gas block 118. Point 117 constitutes a transition from relatively low section modulus to relatively high section modulus. The barrel stabilizer system further includes an adjustable counterweight 119 with internal threads, and lock 120 with internal threads, which cooperate with external threads on the stabilizer at 121. The adjustable counterweight 119 is moved to different positions along the stabilizer 108 by rotation on the threads shown at 121, and then locked in position for gun firing by tightening the lock 120 against the counterweight 119. The adjustable counterweight 119 and lock 120 provide a means of empirically achieving final matching of the stabilizer to the gun during prototype development or as components of a production stabilizer system.

Figure 16:
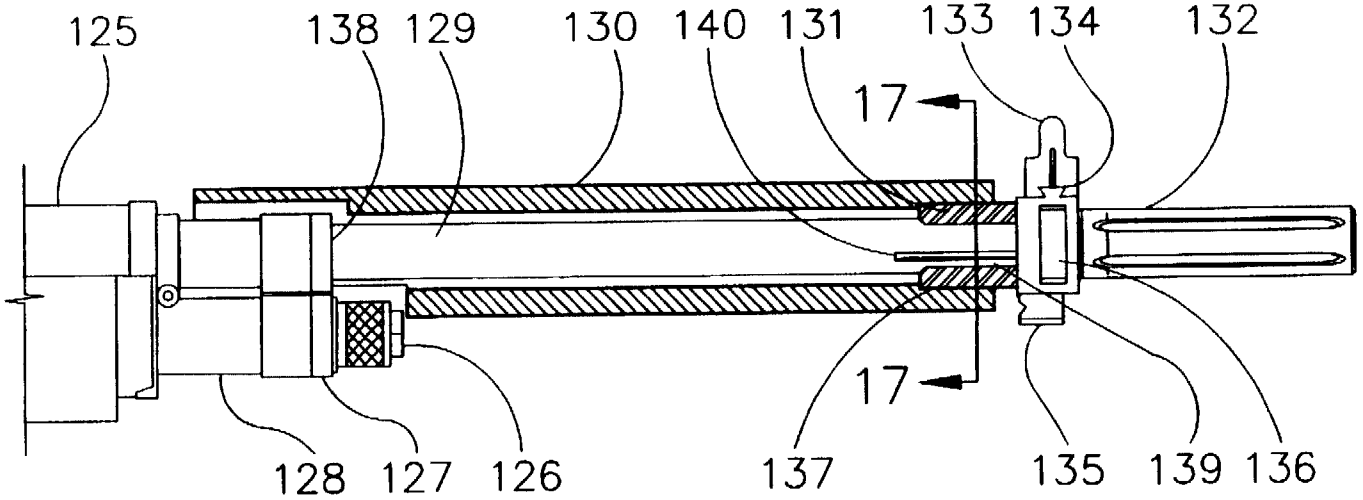
FIG. 16 is a partial sectional side view of the forward components of a U.S. M14 rifle with a seventh preferred embodiment of the present invention installed incorporating lock nut attachment, splined alignment, flash suppressor, bayonet lug, and front sight.

FIG. 16 depicts a seventh preferred embodiment including a forward segment of a U.S. M14 rifle generally indicated at 125 including gas cylinder plug 126, gas cylinder lock 127, gas cylinder 128, and special extended barrel 129. A stepped tubular stabilizer 130 is shown in section installed via a transition piece 131 with integral flash suppressor 132, sight 133, sight base 134, and bayonet lug 135; using lock nut 136 with internal threads engaging external threads on the barrel 129. The stabilizer 130 is joined to the transition piece 131 by bonded attachment at 137. The stabilizer 130 extends rearward from a point behind the sight base 134 beyond a point of transition 138 from relatively low section modulus to relatively high section modulus formed by the intersection of the barrel 129 with the forward surface of the gas cylinder lock 127. The stabilizer 130 is cut away to allow clearance for the gas cylinder lock screw 126, gas cylinder lock 127 and gas cylinder 128. The stabilizer 130 in this embodiment, as with all embodiments of this invention, does not contact the gun barrel or any components connected to the gun barrel rearward of the transition piece 131. A splined interface shown at 139 between the barrel 129 and the transition piece 131 serves to maintain rotational alignment between the barrel stabilizer system and the remainder of the rifle. Spline grooves shown typical at 140 are cut longitudinally at several locations around the barrel 129 in the area of interface with the transition piece 131.

Figure 17:
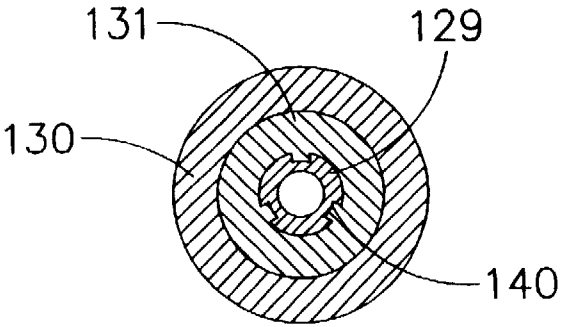
FIG. 17 is a cross section view taken along lines 17—17 of FIG. 16, showing splined alignment detail.

FIG. 17 is an enlarged section view of the splined interface from FIG. 16 showing the barrel 129, stabilizer 130, transition piece 131, and spline grooves 140.

Figure 18:
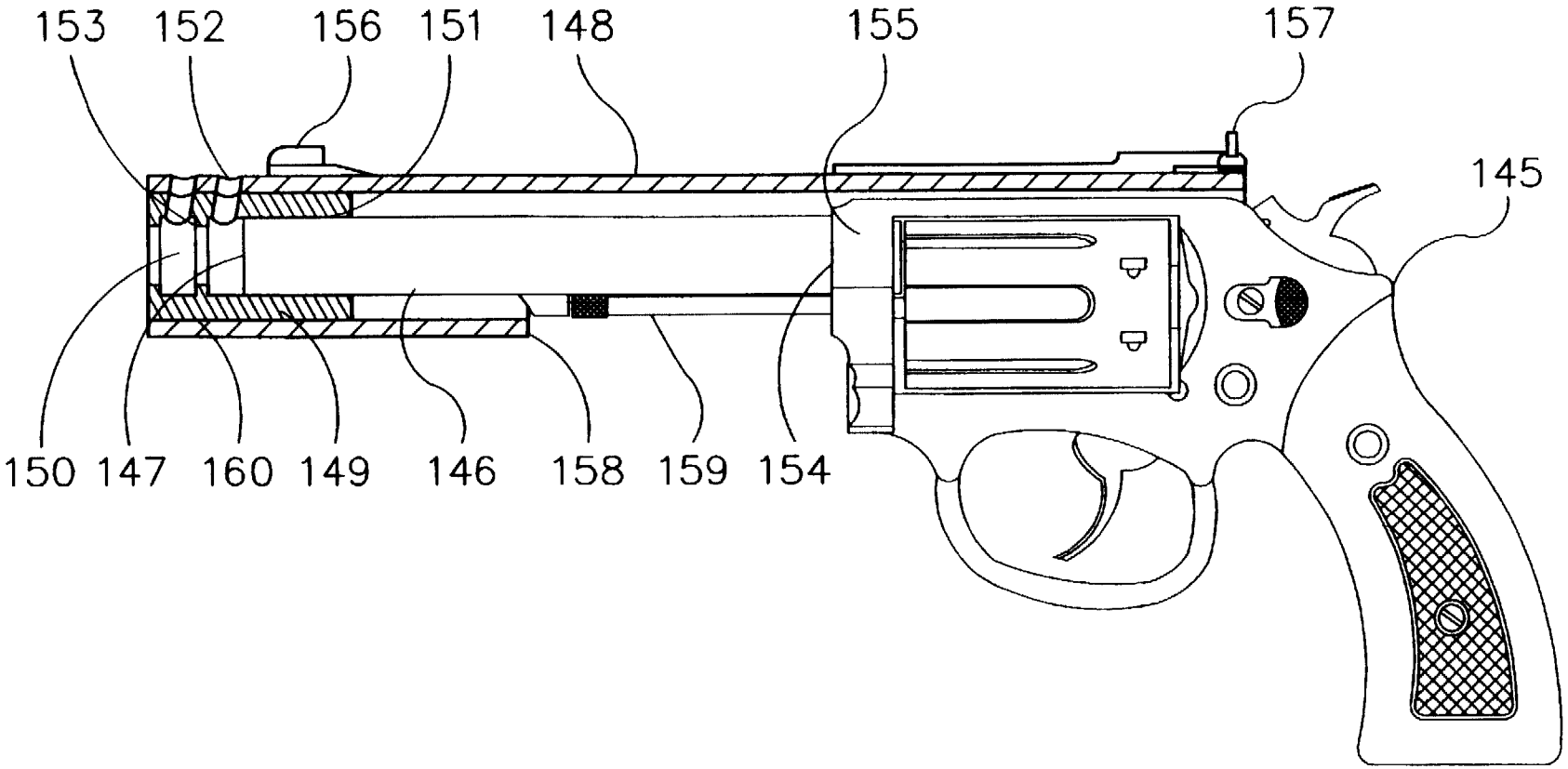
FIG. 18 is a partial sectional side view of a Smith and Wesson handgun with an eighth preferred embodiment of the present invention installed incorporating front and rear sights, compensator, and adhesive bonded attachment.

FIG. 18 depicts an eighth preferred embodiment including a Smith & Wesson revolver shown generally at 145 with modified barrel 146 and distal end 147. A tubular stabilizer 148 is shown in section installed via a transition piece 149, including double chamber compensator 150 using a bonded connection at 151. The compensator includes upward facing ports shown typically at 152 and baffles shown typically at 153. The barrel stabilizer 148 extends rearward from the barrel distal end 147 beyond a point of transition 154 formed by the junction of the barrel 146 with the revolver frame 155. Point 154 serves as the transition from relatively low section modulus to relatively high section modulus. The barrel stabilizer 148 is shown with a front sight 156 and adjustable rear sight 157 installed. The stabilizer 148 which extends rearward from point 154, including rear sight assembly 157, constitutes an extended mass which serves to counteract the added mass of the compensator 150 and front sight 156, and reduced mass resulting from the cutaway at 158. The cutaway at 158 serves to accommodate the ejector rod 159. The stabilizer 148 is joined to the transition piece 149 using an interference fit at 160.

While preferred embodiments of the invention have been disclosed, it is intended that the invention be limited only by the appended claims, including reasonable equivalents and combinations of identified features.

What is claimed is:

1. A gun barrel stabilizer system comprising: a stabilizer of predetermined mass and shape, capable of extending rearward from a distal end of the gun barrel without further contact with the gun, and a means of rigid attachment of said stabilizer to said gun at or near said distal end of said gun barrel which allows said stabilizer to extend rearward without further contact with said gun during firing, thereby reducing angular deflection of a final segment of gun bore adjacent to said distal end during firing, to increase gun accuracy.

2. A gun barrel stabilizer system as in claim 1, wherein said shape is tubular, and wherein said means of rigid attachment includes a transition piece within the interior of said stabilizer.

3. A barrel stabilizer system as in claim 2, wherein said means of rigid attachment of the stabilizer to said gun comprises a cylindrical outside surface on said barrel joined to a cylindrical inside surface on said transition piece using a retaining pin; said retaining pin is interference fit in a hole passing though said barrel and barrel stabilizer system on a cord line which avoids any intersection of said hole with the gun bore.

4. A barrel stabilizer system as in claim 2, wherein a cylindrical outside surface on said barrel is joined to a cylindrical inside surface on said transition piece using a bonding material.

5. A barrel stabilizer system as in claim 2, wherein said means of rigid attachment comprises a cylindrical outside surface on said barrel joined to a cylindrical inside surface on said transition piece, cooperating with a narrow longitudinal slot cut through said stabilizer and transition piece at the location of said cylindrical inside surface at interface with said barrel, further cooperating with clamping screws placed perpendicular to said slot on cord lines outside of the interfacing diameter between said barrel and barrel stabilizer system; where said screws, when tightened, produce contact force between said transition piece and said barrel.

6. A barrel stabilizer system as in claim 1, wherein said shape is tubular and said means of rigid attachment comprises a collet clamping system with a cylindrical inner surface which joins to a cylindrical outer surface on said gun barrel; said collet clamping system further comprises: a collet with narrow multiple longitudinal slots; a first conical outer surface on said collet located near the end face of said collet closest to the distal end of said gun barrel, cooperating with a conical inner surface on a lock nut; a second conical outer surface, on said collet located at the collet end opposite from said first conical outer surface, cooperating with a conical inner surface on said stabilizer; threads on said lock nut cooperating with threads on said stabilizer, and serving to capture said collet; thereby producing radial clamping forces on said gun barrel to achieve rigid attachment.

7. A barrel stabilizer system as in claim 2, wherein said means of rigid attachment comprises: exterior threads on said barrel near the muzzle, interior threads on said transition piece, a first shoulder formed by transition of the threaded portion of said barrel to larger unthreaded outside diameter at interface with a corresponding second shoulder on an interior of said transition piece; said exterior threads on said barrel cooperate with said interior threads on said transition piece to hold said second shoulder against said first shoulder.

8. A barrel stabilizer system as in claim 2, wherein said means of rigid attachment of the stabilizer to the distal end of said gun barrel comprises a threaded outside surface on said barrel cooperating with a threaded inside surface on said transition piece, and said exterior threads on said barrel additionally cooperate with internal threads on a lock nut which engages said transition piece.

9. A barrel stabilizer system as in claim 2, wherein said means of rigid attachment comprises: a cylindrical outside surface on said barrel at interface with a cylindrical inside surface on said transition piece, said barrel having a first shoulder at interface with a corresponding second shoulder on the interior of said transition piece, and said barrel having exterior threads cooperating with interior threads on a lock nut to hold said second shoulder against said first shoulder.

10. A barrel stabilizer system as in claim 9, wherein means of rotational alignment is provided to prevent rotation of said stabilizer on said barrel.

11. A barrel stabilizer system as in claim 10, wherein said means of rotational alignment consists of longitudinal grooves cut in the barrel cooperating with raised longitudinal splines present on the interfacing inner cylindrical surface of said transition piece.

12. A barrel stabilizer system as in claim 9, wherein said first and second shoulders have corresponding conical surfaces, and said lock nut has a conical surface at interface with a corresponding conical surface on said transition piece; thereby maintaining concentric alignment of said stabilizer with said barrel.

13. A barrel stabilizer system as in claim 12, wherein means of rotational alignment is provided to prevent rotation of said stabilizer on said barrel.

14. A barrel stabilizer system as in claim 13, wherein said means of rotational alignment consists of longitudinal grooves cut in the barrel cooperating with raised longitudinal splines present on the interfacing inner cylindrical surface of said transition piece.

15. A barrel stabilizer system as in claim 1 wherein said stabilizer includes the added feature of a front sight.

16. A barrel stabilizer system as in claim 15, wherein said stabilizer includes the added feature of a rear sight.

17. A barrel stabilizer system as in claim 1 wherein said stabilizer includes an adjustable counterweight system wherein a weight element is infinitely adjustable over a predetermined range toward and away from said distal end of said gun barrel.

18. A barrel stabilizer system as in claim 2 wherein said stabilizer includes an adjustable counterweight system wherein a tubular weight element is infinitely adjustable over a predetermined range toward and away from said distal end of said gun barrel through cooperation of internal threads on said weight element and external threads on said stabilizer, and a locking means comprising a lock nut threaded onto said external threads and engaged by said weight element.

19. A barrel stabilizer system as in claim 1 wherein said barrel stabilizer system includes the added feature of a flash suppressor.

20. A barrel stabilizer system as in claim 1, wherein said barrel stabilizer system includes the added feature of a bayonet lug.

21. A barrel stabilizer system as in claim 1 wherein said barrel stabilizer system includes the added feature of a muzzle brake.

22. A barrel stabilizer system as in claim 1 wherein said barrel stabilizer system includes the added feature of a compensator.

* * * * *